United States Patent [19]

LaBate

[11] 4,440,534

[45] Apr. 3, 1984

[54] CERAMIC INSERT

[76] Inventor: Micheal D. LaBate, 115 Hazen Ave., Ellwood City, Pa. 16117

[21] Appl. No.: 385,892

[22] Filed: Jun. 7, 1982

Related U.S. Application Data

[60] Division of Ser. No. 251,319, Apr. 6, 1981, Pat. No. 4,391,434, which is a continuation-in-part of Ser. No. 123,369, Feb. 21, 1980, Pat. No. 4,262,885.

[51] Int. Cl.[3] ..... F16B 13/04; C21B 7/14

[52] U.S. Cl. ..... 411/82; 411/427; 266/196; 193/2 R

[58] Field of Search ..... 411/81, 82, 108, 113, 411/166, 167, 177, 178, 432, 385, 389, 904, 908, 427; 266/196, 231, 236; 110/333

[56] References Cited

U.S. PATENT DOCUMENTS 1,436,923 11/1922 Waite ..... 110/333

3,119,472 1/1964 McLeod ..... 411/389

4,262,885 4/1981 La Bate ..... 266/236

FOREIGN PATENT DOCUMENTS 1118379 7/1968 United Kingdom ..... 411/427

1580148 11/1980 United Kingdom ..... 411/427

*Primary Examiner*—Gary L. Smith

*Assistant Examiner*—Neill Wilson

*Attorney, Agent, or Firm*—Harpman & Harpman

[57] ABSTRACT

A ceramic interiorly threaded hollow insert for incorporation in a refractory preformed shape such as hot metal runners into which eyelet carrying bolts may be threaded so that the preformed shapes can be handled by mechanical means. The ceramic insert is made of material similar to that of the preformed shape with which it is used. The ceramic insert is bonded in the preformed shape during the drying and baking formation thereof.

1 Claim, 4 Drawing Figures

CERAMIC INSERT

This is a division of my application Ser. No. 251,319, filed Apr. 6, 1981, now U.S. Pat. No. 4,391,434 which was a continuation-in-part of my application Ser. No. 123,369, filed Feb. 21, 1980, now U.S. Pat. No. 4,262,885.

BACKGROUND OF THE INVENTION (1) Field of the Invention

This invention relates to mountings for eyelet bolts used with refractory based preformed shapes such as used for the handling of molten metal.

(2) Description of the Prior Art

No prior art devices of this type for use with refractory based preformed shapes for handling molten metal are known. Metal rods have been embedded in refractory articles and found unsatisfactory due to the damage from the different rates of expansion incurred during use.

SUMMARY OF THE INVENTION

A ceramic interiorly threaded hollow insert is embedded in a refractory based preformed article such as a hot metal runner. The insert receives a threaded steel eyelet bolt and avoids damage from the unequal expansion rates of the refractory material and the bolt. With the use of the eyelet bolt, the preformed runner can be readily handled by mechanical equipment.

DESCRIPTION OF THE PREFERRED EMBODIMENT

Figure 1:
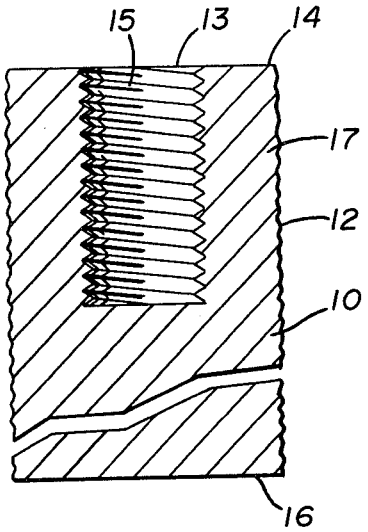
FIG. 1 is an enlarged cross sectional view of the ceramic insert with parts broken away.
Figure 2:
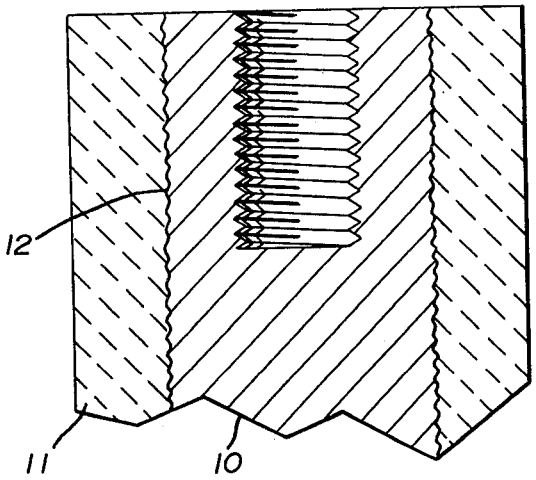
FIG. 2 is an enlarged cross sectional view of the ceramic insert embedded in a refractory based shape.
Figure 3:
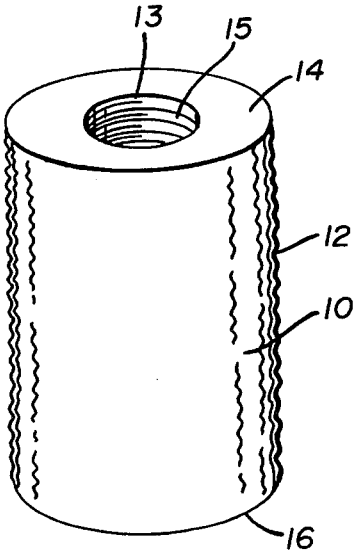
FIG. 3 is a perspective view of the ceramic insert of FIG. 1.
Figure 4:
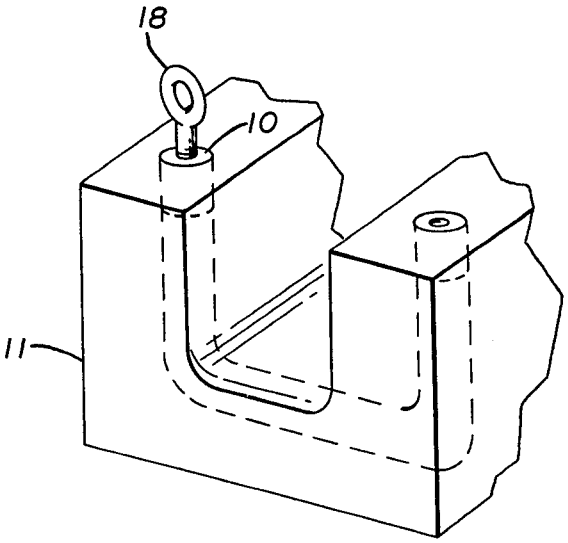
FIG. 4 is a perspective view of a portion of the preformed refreactory article showing the ceramic insert therein with broken lines showing a modification thereof.

One form of a ceramic insert 10 is illustrated in FIGS. 1 and 2 of the drawings and by referring to FIGS. 2 and 4 of the drawings, the ceramic insert 10 will be seen in use in a preshaped refractory based article such as a hot metal runner 11. The hot metal runner 11 can be made of any refractory based material consisting of but not restricted to a mixture of aluminum oxide, raw fire clay, ground fired brick grog, refractory cement and phosphoric acid ($H_3O_4P$). The mixture is rammed into a mold, dried, heated and baked for several days forming a solid heat resistant shape. The ceramic insert 10 in the form illustrated in FIGS. 1,2 and 3 of the drawings, has a cylindrical configuration with an outermost rough surface 12, an annular cavity 13 is formed inwardly from an upper end 14 and a thread pattern 15 is formed in the wall of the cavity 13. The upper end 14 about the cavity 13 is flat and the lower portion of the insert 10 below the cavity 13 is solid forming a lower end 16. The central positioning of the annular cavity 13 maintains the uniform wall thickness of the ceramic insert 10 around the cavity 13.

The wall thus defined is indicated by the numeral 17.

The ceramic insert 10 is positioned in the refractory based material of the preshaped hot metal runner 11 when it is formed as seen in FIG. 2 of the drawings. The thread pattern 15 in the cavity 13 of the ceramic insert 10 will receive a threaded steel eyelet bolt 18 as seen in FIG. 4 of the drawings. The steel eyelet bolt 18 allows for machine handling of the preformed hot metal runner 11. The bolt 18 can be made of inexpensive carbon steel.

The ceramic insert 10 is made of a refractory base ceramic material similar to that of the hot metal runner 11 in which it is placed as hereinbefore described when the runner 11 is made.

A preferred ceramic material from which the ceramic insert 10 may be formed comprises a mixture of 81.5% of Mulcoa brand refractory mix supplied by the C & E Refractories Company, containing 60% aluminum oxide as its primary ingredient, 13.6% of raw fire clay, 5% pure aluminum oxide ($Al_2O_3$). These materials are mixed with phosphoric acid ($H_3O_4P$) and packed into molds around a threaded core bar to form the thread pattern 15 in the insert 10. The molded insert 10 is dried and placed in the refractory article, such as the hot metal runner 11 as seen in FIG. 4 of the drawings, and baked. During this baking a chemical reaction occurs between the aluminum oxide $Al_2O_3$) and the phosphoric acid ($H_3O_4P$) which precipitates as salt in a hard form which bonds the ceramic insert 10 to the refractory material of the preshaped hot metal runner 11. Alternate mixtures can be used depending on the composition of the article in which the ceramic inserts are used. One example comprises a mixture of 46% Mulcoa brand refractory mix which contains 70% aluminum oxide and 31.25% silican carbon, 10% graphite which is in the powdered 99% pure form and 12.7% fire clay all of which are mixed with phosphoric acid.

It will be seen that a modified form of the ceramic insert 10, such as a generally U-shaped configuration 20 is illustrated in FIG. 4 of the drawings to provide a more extensive engagement in the preshaped refractory article. Such a modification evenly distributes the lifting force applied to the preshaped refractory based article in which the modified ceramic insert is embedded. In use a wire cable, not shown, is passed through the eyelet bolts 18 and attached to a lifting device such as a crane. The preshaped refractory article which is quite large and heavy may thus be easily moved and placed as desired as for example forming a continuous hot metal runner trough.

The bonding of the ceramic insert 10 into the preshaped refractory article helps to form a unitized reinforced article thus equalizing the stress on any one portion thereof.

It will thus be seen that a new and useful ceramic insert has been illustrated and described and it will be apparent to those skilled in the art that various and changes and modifications may be made therein without departing from the spirit of the invention and having thus described my invention what I claim is:

1. A ceramic insert for incorporation in a refractory article, the insert comprising a cylindrical body member of uniform diameter having a cavity axially inwardly of one end thereof and extending no more than half the axial distance of said body member, a thread pattern formed in the area of the body member defining said cavity, said insert formed of a mixture of 81.5% by weight Mulcoa brand refractory mix containing 60% aluminum oxide, 5% pure aluminum oxide ($Al_2O_3$) and 13.5% raw fire clay together with 18.5% by weight phosphoric acid ($H_3O_4P$) so that the pure aluminum oxide will react with the phosphoric acid to precipitate as a hard salt bonding the ceramic insert to the refractory article when said refractory article is baked, a rough surface on the exterior of said cylindrical body arranged to engage said refractory article in non-slip relation when said insert is embedded therein prior to said baking.

* * * * *